US009353548B2

(12) United States Patent
Fustini

(10) Patent No.: US 9,353,548 B2
(45) Date of Patent: May 31, 2016

(54) REKEYABLE CYLINDER

(75) Inventor: Fausto Fustini, Imola (IT)

(73) Assignee: Cisa S.p.A., Faenza (IT)

( * ) Notice: Subject to any disclaimer, the term of this patent is extended or adjusted under 35 U.S.C. 154(b) by 17 days.

(21) Appl. No.: 14/232,792

(22) PCT Filed: Jul. 15, 2011

(86) PCT No.: PCT/IT2011/000250
§ 371 (c)(1),
(2), (4) Date: Jan. 14, 2014

(87) PCT Pub. No.: WO2013/011527
PCT Pub. Date: Jan. 24, 2013

(65) Prior Publication Data

US 2015/0191934 A1 Jul. 9, 2015

(51) Int. Cl.
*E05B 27/00* (2006.01)

(52) U.S. Cl.
CPC ..... *E05B 27/0017* (2013.01); *E05B 27/005* (2013.01); *Y10T 70/7588* (2015.04)

(58) Field of Classification Search
CPC ..... E05B 27/005; E05B 27/0017; Y10T 70/7599; Y10T 70/7734; Y10T 70/7605; Y10T 70/7559; Y10T 70/774; Y10T 70/7588
USPC ..... 70/382–384, 378, 368
See application file for complete search history.

(56) References Cited

U.S. PATENT DOCUMENTS 1,610,224 A * 12/1926 Dalboni et al. ..... 70/382
1,965,889 A * 7/1934 Fitz ..... 70/419

(Continued)

FOREIGN PATENT DOCUMENTS

EP 228507 A2 7/1987

OTHER PUBLICATIONS

International Search Report issued by European Patent Office PCT/IT2011/000250, mailed May 18, 2012.

*Primary Examiner* — Suzanne Barrett
(74) *Attorney, Agent, or Firm* — Frommer, Lawrence & Haug LLP

(57) ABSTRACT

A rekeyable cylinder (1) comprising a stator (2) provided with a substantially cylindrical receptacle (3) for a rotor (4). The rotor (4) and the stator (2) are affected by channels (5) for at least one respective pin, movable so that it can slide in them in contrast to respective elastic means. The simultaneous arrangement of the pins partly in the rotor (4) and partly in the stator (2) determines the locking of the rotor (4), and the alignment of a terminal edge of the pins with the interface surface between stator (2) and rotor (4), obtained through the insertion of an adapted key (7) with a contoured profile into an opening (6) of the rotor (4) that faces the channels (5), determines the free rotation of the rotor (4) with respect to the stator (2). At least one of the pins is constituted by a pair of substantially complementary valves (9, 11) which are provided, along at least one respective mutual coupling surface, with at least one respective profile (10), the first valve (9), and with at least one corresponding counter-profile (12), the second valve (11). The first valve (9) can perform a translational movement with respect to stator (2) and rotor (4), and the second valve (11) can perform a translational and rotational movement, along a preset angular stroke, with respect to stator (2) and rotor (4). The second valve (11) comprises abutment means for a specific utensil (13) pertaining thereto through an auxiliary duct (14) of the rotor (4) that faces the abutment means.

8 Claims, 7 Drawing Sheets

(56) References Cited

U.S. PATENT DOCUMENTS

| | | | | | |
|---|---|---|---|---|---|
| 2,194,469 | A | | 3/1940 | Fremon | |
| 3,589,153 | A | * | 6/1971 | Hill | 70/384 |
| 3,910,083 | A | * | 10/1975 | Burlingame | 70/383 |
| 3,987,654 | A | * | 10/1976 | Iaccino et al. | 70/494 |
| 3,990,282 | A | * | 11/1976 | Sorum | 70/495 |
| 3,999,413 | A | * | 12/1976 | Raymond et al. | 70/495 |
| 4,376,382 | A | * | 3/1983 | Raymond et al. | 70/338 |
| 5,682,779 | A | | 11/1997 | Dolev | |
| 6,119,495 | A | * | 9/2000 | Loreti | 70/340 |
| 6,860,131 | B2 | * | 3/2005 | Armstrong et al. | 70/492 |
| 7,114,357 | B2 | * | 10/2006 | Armstrong et al. | 70/492 |
| 8,621,902 | B2 | * | 1/2014 | Mathachan | 70/492 |
| 2005/0172687 | A1 | * | 8/2005 | Segien et al. | 70/493 |
| 2006/0059965 | A1 | | 3/2006 | Benstead | |
| 2008/0236224 | A1 | * | 10/2008 | Chong | 70/358 |
| 2009/0277240 | A1 | | 11/2009 | Huang et al. | |

* cited by examiner

REKEYABLE CYLINDER

TECHNICAL FIELD

The present invention relates to a rekeyable cylinder.

BACKGROUND ART

As is known, the cylinder is the main active component of a lock. It is constituted by a stator which is integral with the lock, inside which a rotor can be selectively rotated. The rotor is provided with an opening for the insertion of a coded key. Between rotor and stator, adapted pins are interposed, kept elastically in a position of interference between rotor and stator, of preset length, the coding pattern of the key enabling the alignment of the terminal edge of each pin with the interface surface between stator and rotor, with consequent freedom of rotation of the rotor with respect to the stator.

The coding pattern of the key consists in the provision of a contoured profile thereon which has a progression such that, once the key is completely inserted in the opening of the corresponding rotor, the edge of each pin, pushed by a corresponding portion of the contoured profile of the key in contrast to elastic means, is aligned with the interface surface between rotor and stator.

The main drawback of this type of cylinder is constituted by the need to completely replace the cylinder if a key is lost (or stolen or copied). In fact it is not possible to modify the length of the pins, in order to modify the characteristics of the contoured profile of the key adapted to open the cylinder.

Therefore the replacement of the cylinder is necessary for preventing a malicious person from being able to gain access to the area protected by the lock that is governed by the cylinder by actuating it by means of the key that was found, stolen or copied.

The necessity is therefore obvious of carrying out extremely expensive operations to replace the cylinders whenever a key is lost or stolen or copied.

Particularly innovative cylinders do exist which are supplied directly by the producer with two or more accompanying sets of keys. If one of the keys of one of the sets is lost, it is possible, after subjecting the cylinder to a series of codified and complex operations, to modify its coding pattern thus adapting it to one of the keys of the at least one other set.

The cost of these innovative cylinders is very high and moreover they limit the possibilities of the user since they generally allow only one change of the coding pattern (the cylinder is generally associated with only two sets of keys). Therefore, if a key of the second set is lost (once a first change of coding pattern has been performed) it will be necessary to replace the entire cylinder.

DISCLOSURE OF THE INVENTION

The aim of the present invention is to solve the above-mentioned problems, by providing a rekeyable cylinder of great versatility.

Within this aim, an object of the invention is to provide a rekeyable cylinder that is adapted to be subjected to an indefinite number of different encodings.

Another object of the present invention is to provide a rekeyable cylinder which is low-cost, easy and practical to implement and safe to apply.

This aim and these and other objects, which will become more evident hereinafter, are achieved by a rekeyable cylinder of the type comprising a stator provided with a substantially cylindrical receptacle for a rotor, said rotor and said stator including channels for at least one corresponding pin, movable so that it can slide in them in contrast to respective elastic means, the simultaneous arrangement of said pins partly in said rotor and partly in said stator determining the locking of said rotor, the alignment of a terminal edge of said pins with the interface surface between stator and rotor, obtained through the insertion of an adapted key with a contoured profile into an opening of the rotor that faces the channels, determining the free rotation of said rotor with respect to said stator, characterized in that at least one of said pins is constituted by a pair of substantially complementary valves which are provided, along at least one respective mutual coupling surface, with at least one respective profile, the first valve, and with at least one corresponding counter-profile, the second valve, said first valve being able to perform a translational movement with respect to said stator and rotor, said second valve being able to perform a translational and rotational movement, along a preset angular stroke, with respect to said stator and rotor, and said second valve comprising abutment means for a specific utensil pertaining thereto through an auxiliary duct of said rotor that faces said abutment means.

BRIEF DESCRIPTION OF THE DRAWINGS

Further characteristics and advantages of the invention will become more apparent from the detailed description that follows of a preferred, but not exclusive, embodiment of the rekeyable cylinder according to the invention, which is illustrated for the purposes of non-limiting example in the accompanying drawings wherein.

WAYS OF CARRYING OUT THE INVENTION

Figure 2:
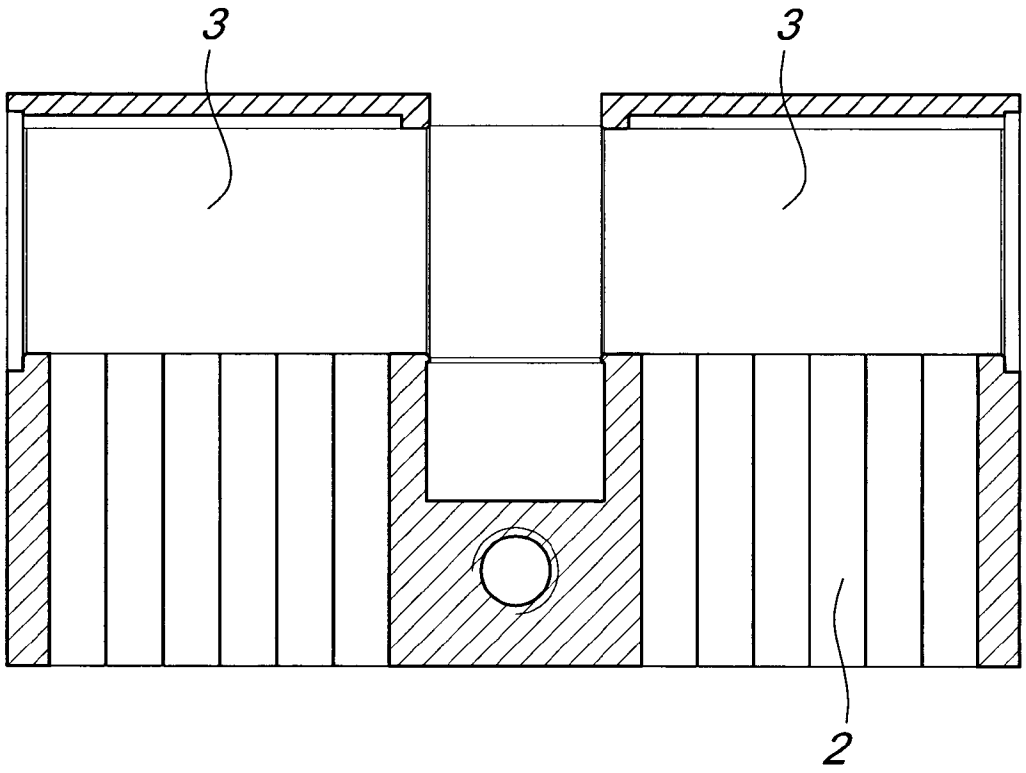
FIG. 2 is a longitudinal sectional view of the stator in FIG. 1.
Figure 1:
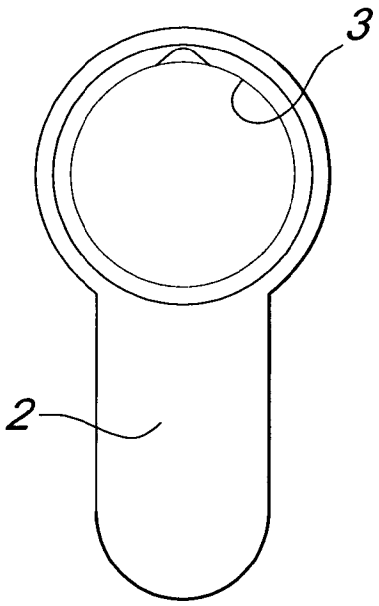
FIG. 1 is a front view of the stator of a lock according to the invention.
Figure 3:
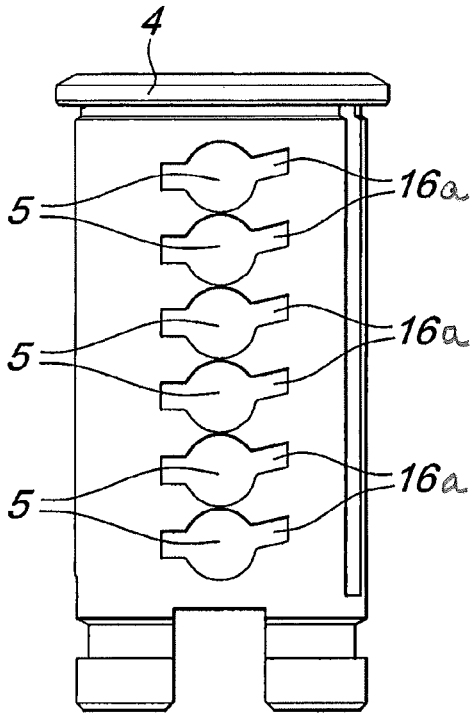
FIG. 3 is a side view of the rotor of a lock according to the invention.
Figure 4:
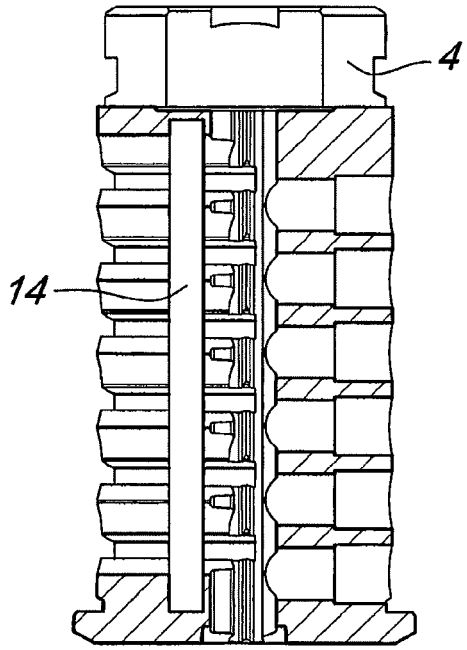
FIG. 4 is a longitudinal sectional view of the rotor in FIG. 3.
Figure 5:
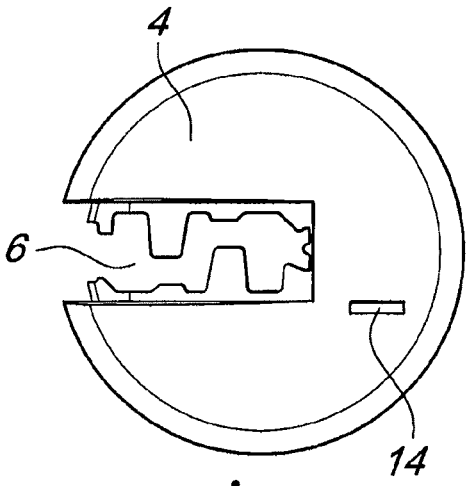
FIG. 5 is a front view of the rotor in FIG. 3.
Figure 6:
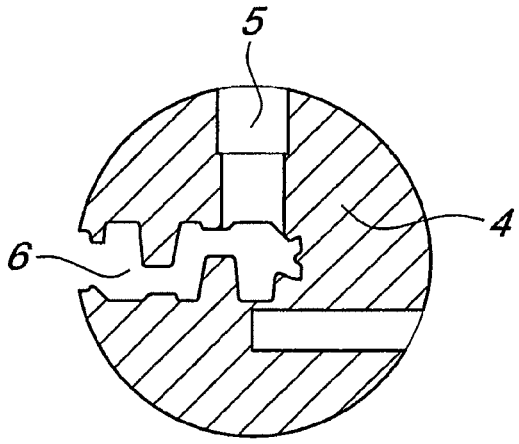
FIG. 6 is a cross-sectional view of the rotor in FIG. 3.
Figure 7:
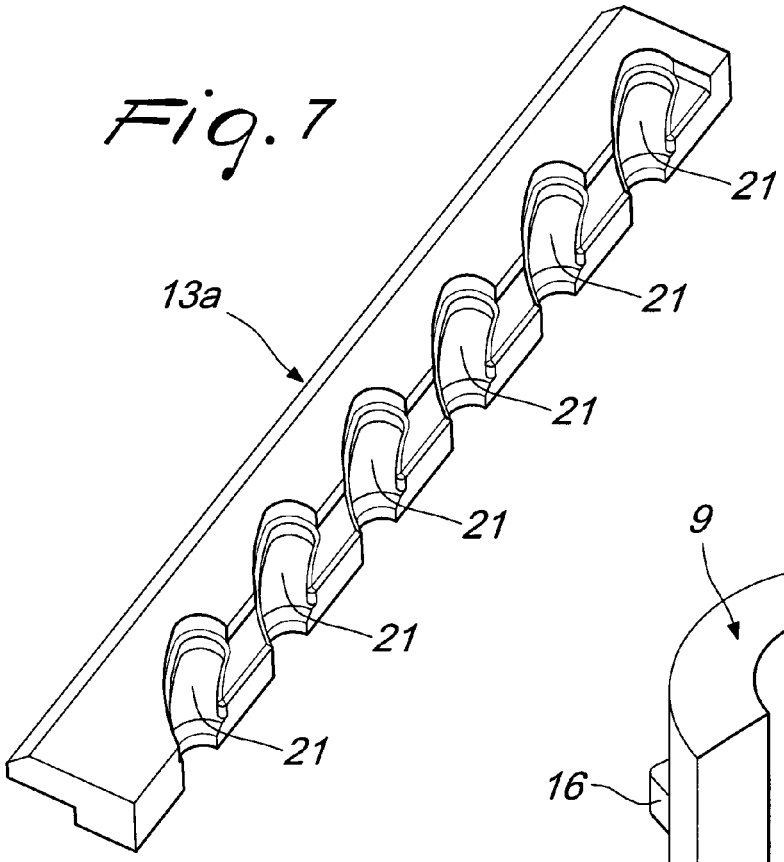
FIG. 7 is a perspective view of a utensil for changing the coding pattern of a lock according to the invention.
Figure 8:
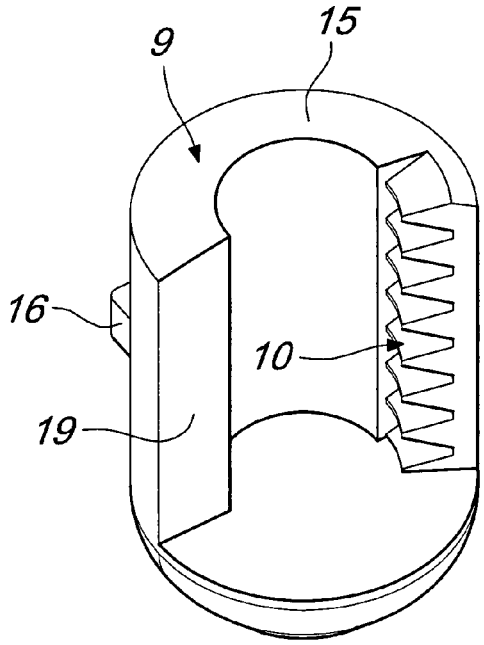
FIG. 8 is a perspective view of a sliding component of a lock according to the invention.
Figure 9:
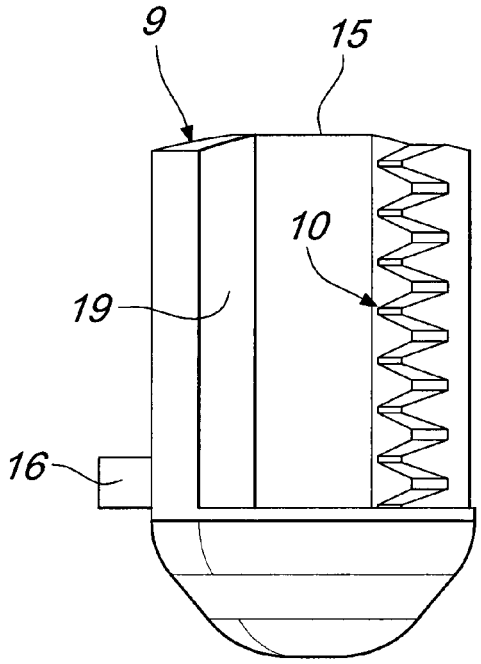
FIG. 9 is a side view of the component in FIG. 8.
Figure 10:
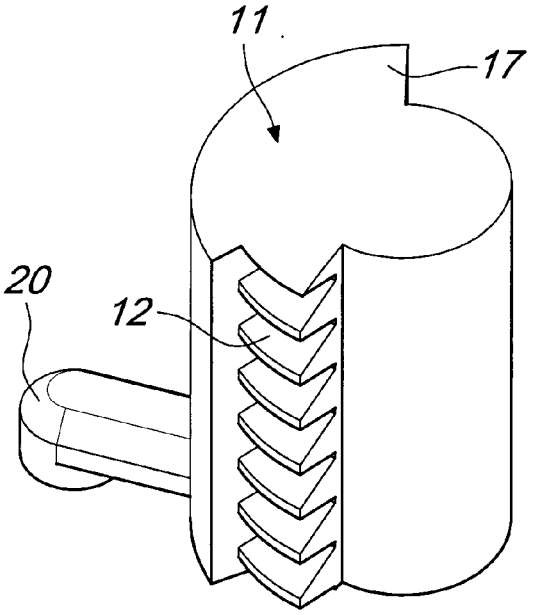
FIG. 10 is a perspective view of a sliding and rotating component of a lock according to the invention.
Figure 11:
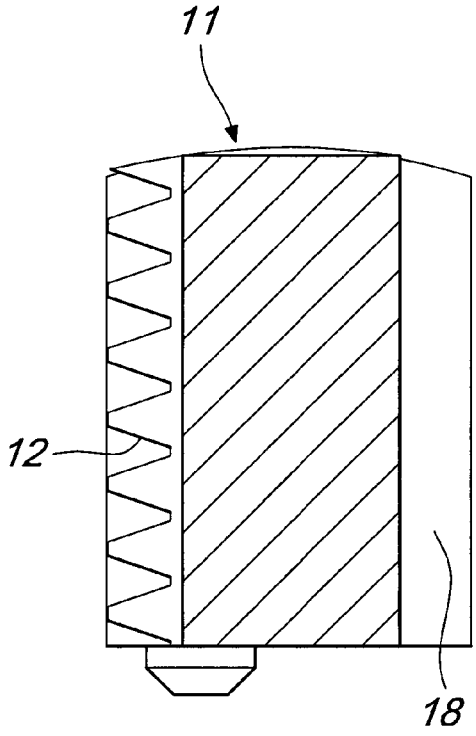
FIG. 11 is a side view of the component in FIG. 10.
Figure 12:
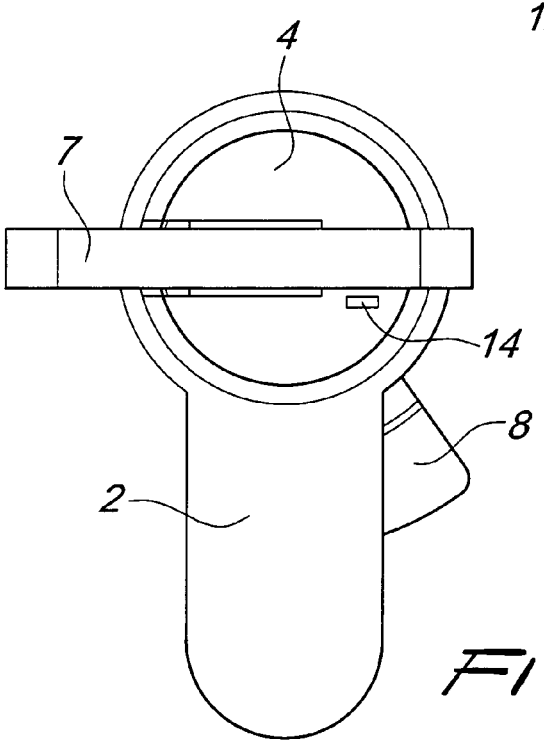
FIG. 12 is a schematic view of a first step a) of changing the coding pattern in a lock according to the invention.
Figure 13:
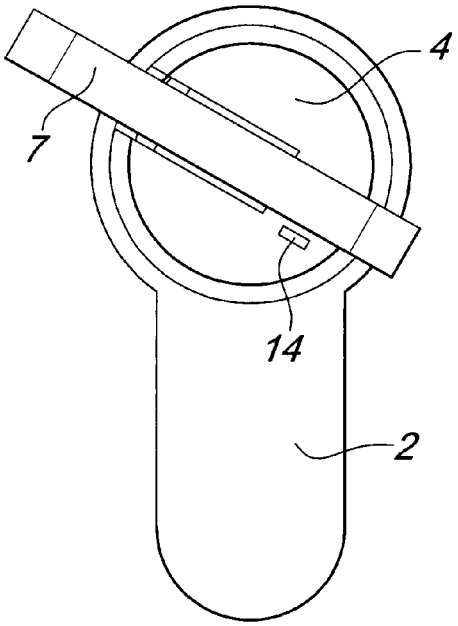
FIG. 13 is a schematic view of a second step b) of changing the coding pattern in a lock according to the invention.
Figure 14:
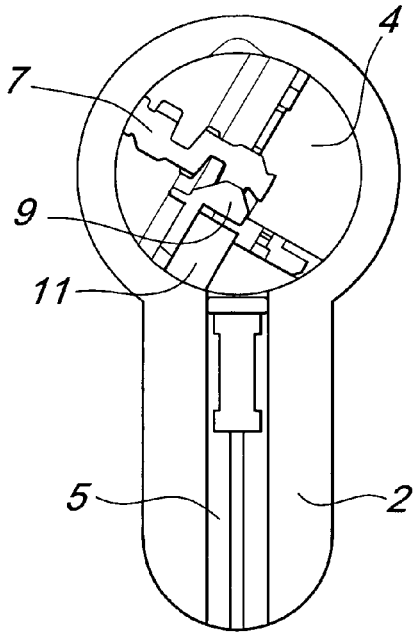
FIG. 14 is a schematic view, sectioned along a transversal plane, of the second step b) of changing the coding pattern in a lock according to the invention.
Figure 15:
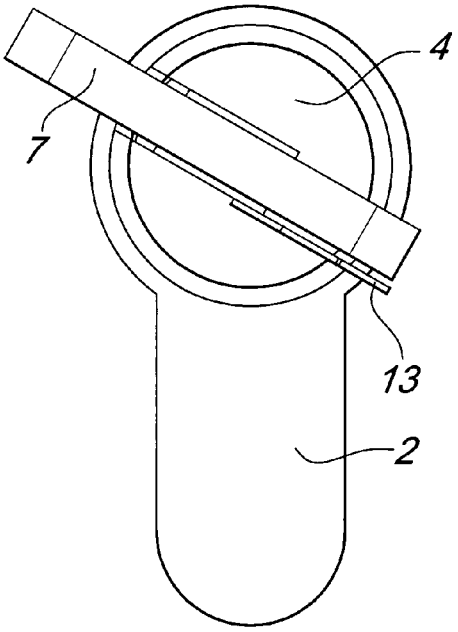
FIG. 15 is a schematic view of a third step c) of changing the coding pattern in a lock according to the invention.
Figure 16:
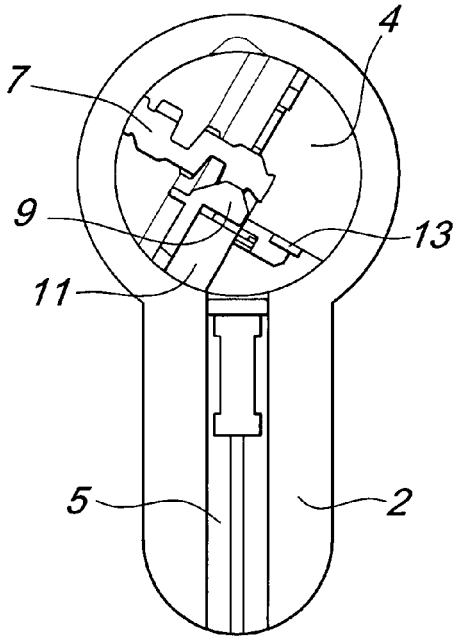
FIG. 16 is a schematic view, sectioned along a transversal plane, of the third step c) of changing the coding pattern in a lock according to the invention.
Figure 17:
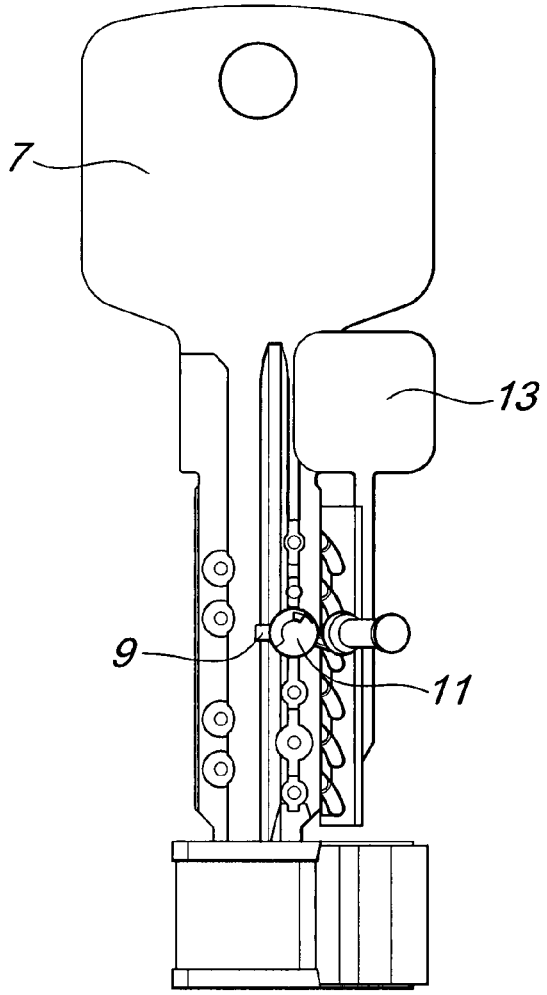
FIG. 17 is a partial schematic view, sectioned along a longitudinal plane, of the third step c) of changing the coding pattern in a lock according to the invention.
Figure 18:
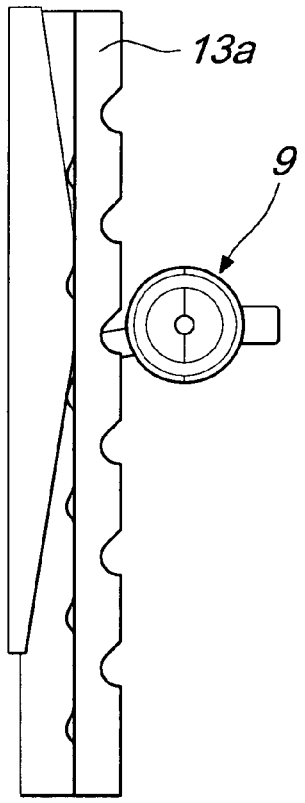
FIG. 18 is a schematic view of the coupling between the two valves constituting a pin and the utensil in the third step c) of changing the coding pattern in a lock according to the invention.
Figure 19:
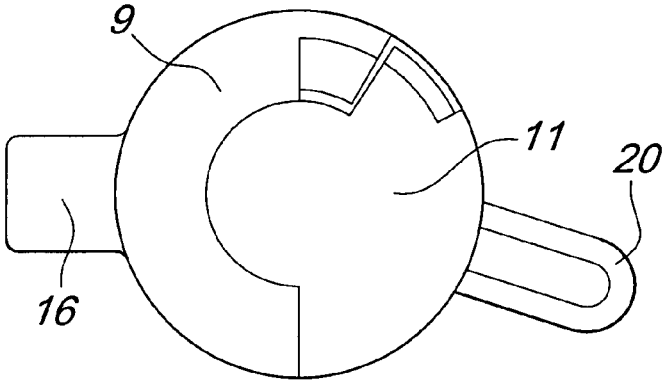
FIG. 19 is a schematic view of the coupling between the two valves constituting a pin in the third step c) of changing the coding pattern in a lock according to the invention.
Figure 20:
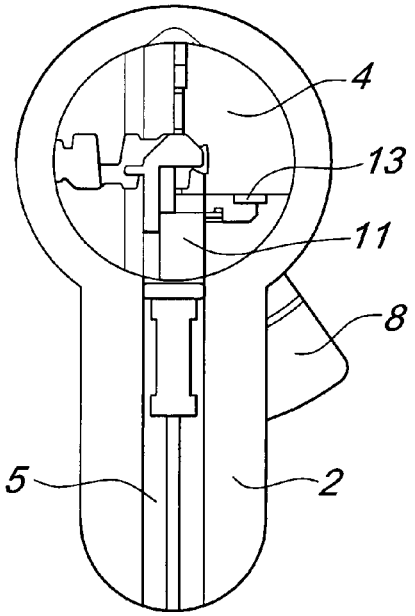
FIG. 20 is a schematic view, sectioned along a longitudinal plane, of a fourth step d) of changing the coding pattern in a lock according to the invention.
Figure 21:
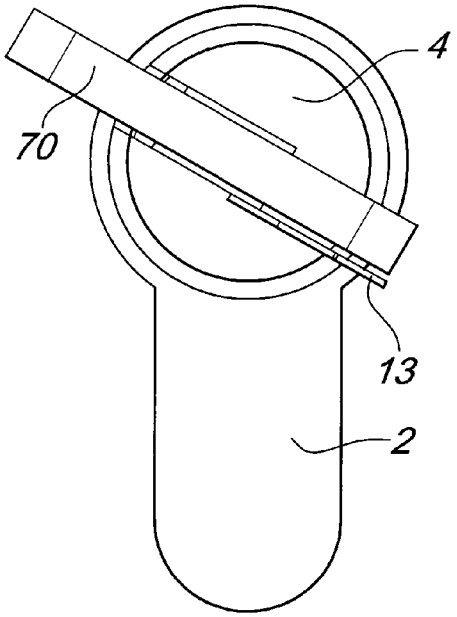
FIG. 21 is a schematic view of a fifth step e) of changing the coding pattern in a lock according to the invention.
Figure 22:
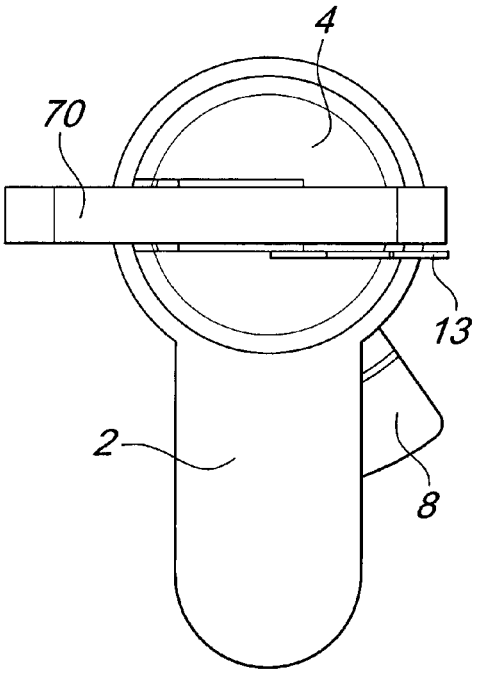
FIG. 22 is a schematic view of a sixth step f) of changing the coding pattern in a lock according to the invention.
Figure 23:
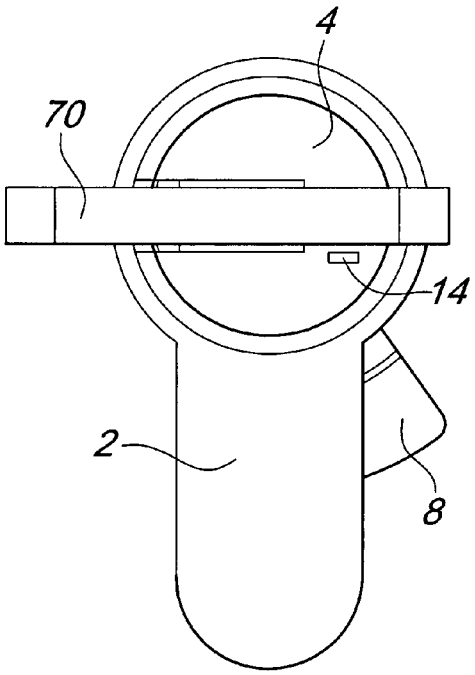
FIG. 23 is a schematic view of a seventh step g) of changing the coding pattern in a lock according to the invention.

With reference to the figures, the reference numeral 1 generally designates a rekeyable cylinder.

Specifically, the rekeyable cylinder 1 comprises a stator 2 provided with a substantially cylindrical receptacle 3 for a rotor 4.

The rotor 4 and the stator 2 include channels 5 for at least one respective pin, movable so that it can slide in it in contrast to respective elastic means.

Specifically, in each channel there is a pin, a counterpin with its terminal end resting on the head of the pin and a spring with axial action with its terminal end resting on the initial end of the counterpin and its initial end resting on the bottom of the channel.

The elastic action of the spring forces the pin into a position of simultaneous interference with the rotor 4 and the stator 2. In practice, the pin is at the same time accommodated in a portion of the channel formed inside the rotor 4 and in a portion of the channel formed inside the stator 2 which prevents the mutual rotations.

Naturally, at a cylinder 1 provided with a plurality of pins (which are generally of differing lengths as a function of the coding pattern of the cylinder 1 and the corresponding key 7) the rotor 4 is always unable to rotate with respect to the stator 2 whenever at least one of these pins is arranged at the same time in a portion of its channel defined in the rotor 4 and in a corresponding portion defined in the stator 2.

However, if, thanks to the insertion, into an opening 6 of the rotor 4, of the key 7 having the correct coding pattern (that is to say, a shape of its profile corresponding to the dimensions of the various pins present), there is an alignment of a terminal edge of the pins with the interface surface between stator 2 and rotor 4, then this determines the free rotation of the rotor 4 with respect to the stator 2 with the consequent ability of the bit 8 to command the movement of the optional spring latch/bolt present in the lock associated with the cylinder 1.

According to the invention, at least one of these pins is constituted by a pair of substantially complementary valves 9, 11 which are provided, along at least one respective mutual coupling surface, with a profile.

In particular, the first valve 9 has a profile 10 and the second valve 11 has a corresponding counter-profile 12.

The first valve 9 can perform a translational movement with respect to the stator 2 and to the rotor 4. This is to allow the pin to slide along the corresponding accommodation channel 5 so as to define a mechanical behavior similar to that of a traditional pin in a traditional cylinder (the second valve 11, in fact, in the configuration of operation of the cylinder 1, is integral with the first valve 9 and therefore performs a translational movement with it inside the corresponding channel 5).

The second valve 11 can perform a translational (jointly with the first valve 9 during the normal use of the cylinder 1) and rotational movement, along a preset angular stroke, with respect to the stator 2 and to the rotor 4 (the rotation can also occur with respect to the first valve 9 which cannot, however, rotate with respect to the stator 2 and to the rotor 4).

The second valve 11 comprises abutment means for a specific utensil 13 pertaining thereto through an auxiliary duct 14 of the rotor 4, the duct 14 facing the abutment means of the second valve 11.

The mutual coupling of the first valve 9 and the second valve 11 can occur by different mutual meshings of the profile 10 with the counter-profile 12. The different position of meshing determines a different overall height of the pin constituted by the two valves 9 and 11 coupled in that configuration.

This means that the pin constituted by the two valves 9 and 11 can have a length that varies as a function of the configuration of mutual meshing.

According to a particular embodiment, described for illustrative and non-limiting purposes, the first valve 9 can be constituted by an internally hollow spool that lacks a portion of its lateral tubular surface 15.

Along one of the two terminal edges of the lateral tubular surface 15 the profile 10 for the selective coupling with the second valve 11 is provided in this case.

With particular reference to the embodiment described previously, the first valve 9 can thus comprise, along the lateral tubular surface 15, substantially on the side opposite the missing portion, a protruding tooth 16 that is adapted to slide inside a corresponding groove 16*a* of the channel 5 for the translational movement of the pin constituted by the first valve 9 and the second valve 11.

The protruding tooth 16 is positively adapted to prevent the rotation of the pin (specifically of the first valve 9 and, when they are mechanically coupled, of the second valve 11) with respect to the rotor 4 and to the stator 2.

With specific reference to an embodiment of undoubted applicative interest, for the purpose of clarifying the characteristics of a specific application of the invention without limiting its scope, the second valve 11 is constituted by an insert of a shape and size that are substantially complementary to those of the spool constituting the first valve 9.

It should be noted that, in this case, the amplitude of the angle delimiting the outer lobe 17, aligned with the lateral tubular surface 15 of the first valve 9, is smaller than the angular amplitude of the lateral tubular surface 15 of the first valve 9.

The difference between the two angular amplitudes of the lateral tubular surface 15 and of the lobe 17 defines the preset angle of possible mutual rotation of the second valve 11 with respect to the first valve 9.

In fact the second valve 11 can rotate from a first configuration in which its counter-profile 12 is engaged in the profile 10 of the first valve 9 to a second configuration in which its abutment surface 18 rests on the corresponding abutment surface 19 of the first valve 9.

Along one end face of the lobe 17 (the face opposite the abutment surface 18) there is the counter-profile 12 for selective coupling with the first valve 9 (specifically, for the coupling with profile 10 of the first valve 9).

The second valve 11 comprises, along the outside of the lobe 17, substantially on the side opposite the area intended for coupling with the first valve 9, a projection 20 that constitutes the abutment means for the utensil 13 mentioned previously.

The operation of the utensil 13 on the projection 20 determines a rotation of the second valve 11 with respect to the first valve 9 by a preset angle with consequent mutual spacing and disengagement of the profile 10 and the counter-profile 12.

According to a particular embodiment of particular practical and applicative interest the preset angle has a value of approximately 30°. The possibility is not excluded of using different angles of rotation according to the specific applicative requirements.

The profile 10 and the counter-profile 12 are preferably constituted by specific gear-cuttings that substantially have the shape of a toothed rack.

According to this specific embodiment, the gear-cutting of the first valve 9 is coupled selectively and removably with that of the second valve 11, just as the gears of two toothed racks are mutually coupled.

According to a particular embodiment, shown in the accompanying Figures solely for the purposes of illustration, with no limitation on the breadth of application of the present invention, the utensil 13 can be constituted by an elongated element provided with at least one indentation 21 of a size and shape substantially complementary to those of the projection 20 that protrudes from the second valve 11.

Upon insertion of the utensil 13 in the auxiliary duct 14 of the rotor 4, the projection 20 proceeds to engage in the at least one indentation 21 with consequent rotation of the second valve 11 with respect to the first valve 9 through a preset angle. This determines the mutual decoupling of profile 10 and counter-profile 12.

The method of modifying the coding pattern of a rekeyable cylinder 1 consists in a plurality of consecutive steps aimed at varying the length of at least one pin.

First of all, in a first step a), it is necessary to insert the original key 7 into the opening 6 of the rotor 4 (key 7 with a profile adapted to bring the pin constituted by the two valves 9 and 11 in a position to release the rotor 4 from the stator 2).

Subsequently, in a second step b) it is necessary to rotate the key 7, while it is inserted in the opening 6 of the rotor 4, through a specific angle in a specific direction of rotation. According to a possible applicative example, it can be rotated through an angle of 30° clockwise.

In a third step c) the utensil 13 is inserted into the corresponding duct 14. This determines a rotation of the valve 11 with respect to the valve 9 with consequent decoupling of the profile 10 from the counter-profile 12.

It will then be possible, in the step d), to remove the original key 7 from the opening 6 of the rotor 4.

In a subsequent step e) it is necessary to insert a new key 70 with a different coding pattern (the key 70, at at least the area that will be directed toward at least one pin constituted by the two valves 9 and 11, will have a thickness different from the corresponding thickness of the original key 7).

More specifically the different coding pattern of the new key 70 with respect to the original key 7 will consist in a different progression of a profile thereof. Specifically, the difference in the profile will be located at the part thereof that is directed toward the pin constituted by the pair of valves 9 and 11 when the key 70 is completely inserted into the opening 6.

With the new key 70 inserted, a step f) involves its rotation, while it is inserted in the opening 6 of the rotor 4, by a specific angle (having the same amplitude as the angle of rotation described in the step b)) in the direction of rotation opposite to that of the step b), so as to arrange the cylinder 1 in the initial configuration.

In this way the valve 11 is brought to a height imposed by the shape of the key 70 with respect to the valve 9.

At this point a concluding step g) requires the removal of the utensil 13. The extraction of the utensil 13 determines a counter-rotation of the valve 11 up to the complete coupling of the profile 10 with the counter-profile 12 thus rendering the length of the pin constituted by the two valves 9 and 11 coupled in this configuration stable and fixed.

Advantageously the present invention solves the typical problems of cylinders of the known type, by providing a rekeyable cylinder 1 of great versatility. In fact it can be recoded an indefinite number of times by adopting each time new keys 70 of a type conforming to the cylinder 1, but without these necessarily having to be be supplied as an accessory kit with the purchase of the cylinder 1. If it is necessary to recode the cylinder 1, then the user only has to buy a new key 70 and carry out the steps indicated previously.

The invention, thus conceived, is susceptible of numerous modifications and variations, all of which are within the scope of the appended claims. Moreover, all the details may be substituted by other, technically equivalent elements.

In the embodiments illustrated, individual characteristics shown in relation to specific examples may in reality be interchanged with other, different characteristics, existing in other embodiments.

In practice, the materials employed, as well as the dimensions, may be any according to requirements and to the state of the art.

Where the technical features mentioned in any claim are followed by reference numerals and/or signs, those reference numerals and/or signs have been included for the sole purpose of increasing the intelligibility of the claims and accordingly, such reference numerals and/or signs do not have any limiting effect on the interpretation of each element identified by way of example by such reference numerals and/or signs.

The invention claimed is:

1. A rekeyable cylinder of the type comprising a stator provided with a substantially cylindrical receptacle for a rotor, said rotor and said stator being affected by channels for at least one corresponding pin, movable so that the pin can slide in the channels in contrast to respective elastic means, the simultaneous arrangement of said pins partly in said rotor and partly in said stator determining the locking of said rotor, the alignment of a terminal edge of said pins with an interface surface between stator and rotor, obtained through the insertion of an adapted key with a contoured profile into an opening of the rotor that faces the channels, determining the free rotation of said rotor with respect to said stator, wherein at least one of said pins is constituted by a pair of substantially complementary valves which are provided, along at least one respective mutual coupling surface, with at least one respective profile, the first valve, and with at least one corresponding counter-profile, the second valve, said first valve being able to perform a translational movement with respect to said stator and rotor, said second valve being able to perform a translational and rotational movement, along a preset angular stroke, with respect to said stator and rotor, and said second valve comprising abutment means for an utensil pertaining thereto through an auxiliary duct of said rotor that faces said abutment means, and wherein said first valve is constituted by an internally hollow spool having a lateral tubular surface with a missing a portion thereof, said profile for the selective coupling with said second valve being provided along a terminal edge of said lateral tubular surface.

2. The rekeyable cylinder according to claim 1, wherein said first valve comprises, along said lateral tubular surface, substantially on the side opposite said missing portion, a protruding tooth that is adapted to slide inside a corresponding groove of the channel for the translational movement of said pin constituted by said first valve and said second valve and adapted to prevent the rotation of said pin with respect to said rotor and stator.

3. The rekeyable cylinder according to claim 1, wherein said second valve is constituted by an insert of a shape and size that are substantially complementary to those of said spool constituting said first valve, an amplitude of an angle delimiting an outer lobe, aligned with the lateral tubular surface of said first valve, smaller than an angular amplitude of the lateral tubular surface of said first valve, the difference between the two angular amplitudes of said lateral tubular surface and of said lobe defining a preset angle of possible mutual rotation of said second valve with respect to said first valve.

4. The rekeyable cylinder according to claim 3, wherein along one end face of said lobe, said profile is provided for the selective coupling with said first valve.

5. The rekeyable cylinder according to claim 3, wherein said second valve comprises, along an outside of said lobe, substantially on the side opposite the area intended for coupling with said first valve, a projection that constitutes said abutment means for said utensil, the operation of said utensil on said projection determining a rotation of said second valve with respect to said first valve by a preset angle with consequent mutual spacing and disengagement of said profile, and said counter-profile.

6. The rekeyable cylinder according to claim 1, wherein said profile and said counter-profile are constituted by gear-cuttings that substantially have the shape of a toothed rack, the gear-cutting of said first valve being coupled selectively and removably with the gear-cutting of said second valve.

7. The rekeyable cylinder according to claim 5, wherein said utensil is constituted by an elongated element provided with at least one indentation of a size and shape substantially complementary to those of said projection of said second valve, upon insertion of the utensil in said auxiliary duct of said rotor said projection being engaged in said at least one indentation with consequent rotation of said second valve by a preset angle and mutual decoupling of the profile and the counter-profile.

8. A method of modifying the coding pattern of a rekeyable cylinder, according to claim 1, comprising:

a) inserting the original key into the opening of the rotor;

b) rotating the key, while the key is inserted in the opening of the rotor, by a specific angle in a specific direction of rotation to rotate the cylinder from an initial configuration;

c) inserting the utensil into the corresponding duct;

d) removing the original key from the opening of the rotor;

e) inserting a new key with a different coding pattern than the original key, the different coding pattern having a different progression of a profile thereof, the difference being located at a part thereof that faces said pin constituted by the pair of valves when the new key is completely inserted into said opening;

f) rotating the new key, while said new key is inserted in the opening of the rotor, by a specific angle in the direction of rotation opposite to that of the step b) to arrange the cylinder in the initial configuration; and g) removing the utensil.

* * * * *